US007399168B1

(12) United States Patent
Eberwein

(10) Patent No.: US 7,399,168 B1
(45) Date of Patent: Jul. 15, 2008

(54) AIR DRIVEN DIAPHRAGM PUMP

(75) Inventor: Dennis D. Eberwein, Riverside, CA (US)

(73) Assignee: Wilden Pump and Engineering LLC, Grand Terrace, CA (US)

( * ) Notice: Subject to any disclaimer, the term of this patent is extended or adjusted under 35 U.S.C. 154(b) by 386 days.

(21) Appl. No.: 11/313,266

(22) Filed: Dec. 19, 2005

(51) Int. Cl.
*F04B 43/14* (2006.01)
*F01B 19/02* (2006.01)

(52) U.S. Cl. ..... 417/395; 92/48

(58) Field of Classification Search ..... 417/395, 417/392, 391, 401, 403, 44.9, 112, 413.1; 92/48, 110

See application file for complete search history.

(56) References Cited

U.S. PATENT DOCUMENTS

| | | | | | |
|---|---|---|---|---|---|
| 3,741,689 | A * | 6/1973 | Rupp | 417/393 |
| 4,008,984 | A * | 2/1977 | Scholle | 417/393 |
| 4,123,204 | A * | 10/1978 | Scholle | 417/393 |
| 4,247,264 | A | 1/1981 | Wilden | |
| 4,406,596 | A * | 9/1983 | Budde | 417/393 |
| D275,858 | S | 10/1984 | Wilden | D15/7 |
| 4,549,467 | A | 10/1985 | Wilden et al. | 91/307 |
| D294,946 | S | 3/1988 | Wilden | D15/7 |
| D294,947 | S | 3/1988 | Wilden | D15/7 |
| 4,836,092 | A * | 6/1989 | Heubner et al. | 92/48 |
| 5,169,296 | A | 12/1992 | Wilden | 417/395 |
| 5,378,122 | A * | 1/1995 | Duncan | 417/395 |
| 5,391,060 | A * | 2/1995 | Kozumplik et al. | 417/393 |
| 5,743,170 | A * | 4/1998 | Pascual et al. | 92/103 F |
| 5,957,670 | A | 9/1999 | Duncan et al. | 417/395 |
| 6,158,982 | A | 12/2000 | Kennedy et al. | 417/397 |
| 6,168,394 | B1 * | 1/2001 | Forman et al. | 417/395 |
| 6,280,149 | B1 * | 8/2001 | Able et al. | 417/63 |
| 6,435,845 | B1 * | 8/2002 | Kennedy et al. | 417/395 |
| RE38,239 | E * | 8/2003 | Duncan | 417/395 |
| 2004/0047748 | A1 * | 3/2004 | Roberts et al. | 417/395 |
| 2005/0249612 | A1 | 11/2005 | Distaso et al. | |

OTHER PUBLICATIONS

ALMATEC Design Drawing FP/FD 50 (M 1:1)—Stand Dec. 17, 1998.
ALMATEC AH Design Crawing.

* cited by examiner

*Primary Examiner*—David J. Isabella
*Assistant Examiner*—Rocco Italiano
(74) *Attorney, Agent, or Firm*—Connolly Bove Lodge & Hutz LLP

(57) ABSTRACT

An air driven diaphragm pump includes two diaphragms affixed to a common shaft. The shaft extends through an air valve providing reciprocating pressurized air to the diaphragms through associated air chambers. A pump chamber with intake and exhaust valves is associated with one of the two diaphragms while a further air chamber replaces a pump chamber and is associated with the other of the diaphragms. A passage extends through the shaft and is in communication with the air chamber adjacent to the pump chamber and with the further air chamber converted from the pump chamber.

3 Claims, 1 Drawing Sheet

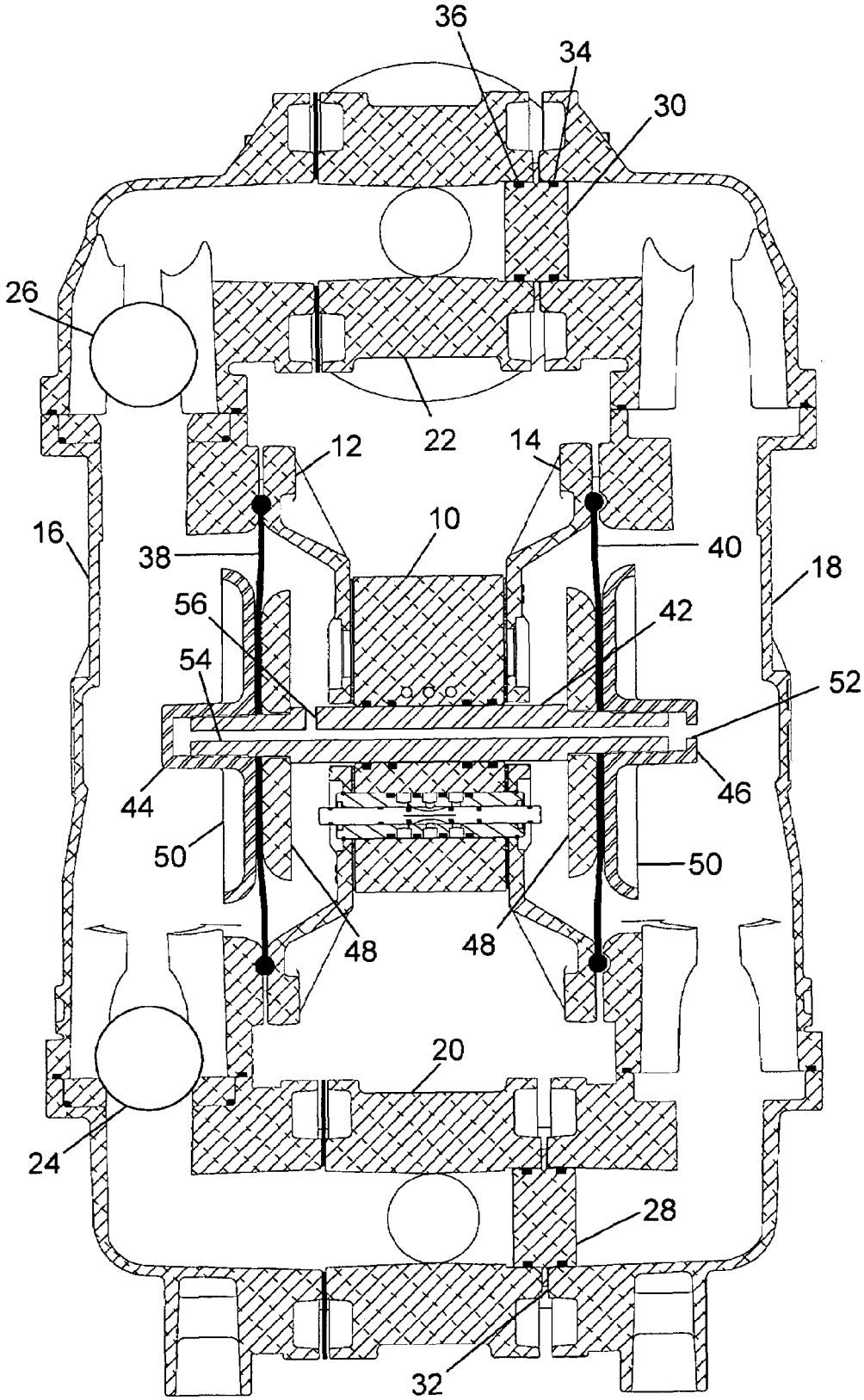
36
34
30
26
22
12
14
10
16
38
40
18
56
42
54
52
44
46
50
50
48
48
20
24
28
32

AIR DRIVEN DIAPHRAGM PUMP

BACKGROUND OF THE INVENTION

The field of the present invention is air driven double diaphragm pumps employed in high pressure configurations.

Air driven double diaphragm pumps employ a source of pressurized air for operation and are quite versatile in their ability to pump a wide variety of material. Pumps having double diaphragms driven by compressed air directed through an actuator valve are found in U.S. Pat. Nos. 5,957,670; 5,169,296; 4,247,264; Des. 294,946; Des. 294,947; and Des. 275,858. Actuator valves used in such pumps are illustrated in U.S. Published Application No. 2005/0249612; and U.S. Pat. No. 4,549,467. The disclosures of the foregoing patents and published application are incorporated herein by reference.

Common to many air driven diaphragm pumps and as shown in the aforementioned patent publications relating to air driven diaphragm pumps is the presence of an actuator housing having air chambers facing outwardly to cooperate with two pump diaphragms. Pump chamber housings with inlet manifolds and outlet manifolds are also common and arranged outwardly of the pump diaphragms. Ball check valves are positioned in both the inlet passageways and the outlet passageways of the pump chamber housings. A shaft runs through the actuator and the air chambers and is coupled with the diaphragms. An air valve controls flow to alternate air pressure and exhaust to and from each of the air chambers, resulting in reciprocation of the pump. The air valve is controlled by a pilot system controlled in turn by the position of the pump diaphragms. Thus, a feedback control mechanism is provided to convert a constant air pressure into a reciprocating distribution of pressurized air to each air chamber for driving the diaphragms in alternating pumping and suction strokes. A vast range of materials are able to be pumped safely and efficiently using such systems.

The aforementioned systems provide a pumping capacity which is limited to the pressure of the supply air behind each diaphragm. Diaphragm pumps have also been developed which multiply that pressure through additional pistons or diaphragms affixed to the central shaft Such additional pistons or diaphragms contribute a boost in force on the shaft cooperative with the diaphragm defining the pump chamber. Reference is made to U.S. Pat. No. 6,158,982.

An additional such mechanism used for increased pumping pressures employs the described double diaphragm pumps with a rerouting of the air about the pump from the air chamber on one side of the pump to the pump chamber on the other side of the pump. The pump chamber is sealed off at both the intake and exhaust. In this manner both diaphragms exert pumping pressure. The pressurized air in the air chamber adjacent to the pumping chamber provides pressure against the associated diaphragm while the pump chamber which has been converted into an air chamber exerts pressure on the other diaphragm resulting in a force on the shaft extending between diaphragms. In this way, an approximate 2:1 ratio of fluid outlet pressure to inlet air pressure is achieved. In the ducting for air flow to the converted pump chamber, fittings and tubing or hoses are employed from the air chamber to the converted pump chamber. Such apparatus are exposed and vulnerable.

SUMMARY OF THE INVENTION

The present invention is directed to an air driven double diaphragm pump which employs a converted pump chamber for increasing the resulting pumping capacity above that provided by a supply of air pressure behind a single diaphragm. The pump includes a shaft extending through the air valve and affixed at its ends to the two diaphragms in a double diaphragm pump. The shaft includes a passage in communication with the air chamber adjacent to the pump chamber and with the pump chamber converted to an air chamber.

Thus, it is an object of the present invention to provide an improved diaphragm pump of increased pressure capacity. Other and further objects and advantages will appear hereinafter.

BRIEF DESCRIPTION OF THE DRAWING

The FIGURE illustrates an air driven diaphragm pump in cross section through the centerline of the central shaft.

DETAILED DESCRIPTION OF THE PREFERRED EMBODIMENT

The preferred embodiment includes a double diaphragm pump such as disclosed in U.S. Pat. No. 5,957,670, the disclosure of which is incorporated herein by reference. The preferred embodiment further includes an air valve as disclosed in U.S. Published Application No. 2005/0249612, the disclosure of which is incorporated herein by reference.

Briefly, the pump includes an air valve 10 positioned between a first air chamber housing 12 and a second air chamber housing 14. The air chamber housings 12 and 14 extend in opposite directions to either side of the air valve 10 to define air chambers which receive pressurized air for reciprocating the pump. Pump chamber housings 16 and 18 are bolted through circular flanges defined by the air chamber housings 12 and 14 and the pump chamber housings 16 and 18 in a conventional manner outwardly of the air chamber housings 12 and 14. Inlet manifold 20 and outlet manifold 22 provide conventional supply and discharge systems along with intake valve 24 and exhaust valve 26.

The pump chamber housing 18 has been converted to a third air chamber housing 18. Plugs 28 and 30 are positioned in the inlet manifold 20 and outlet manifold 22, respectively. Each plug 28, 30 is cylindrical in shape with a flange 32 extending radially outwardly at the center of each cylinder to retain the plugs 28, 30 in place. Sealing is accomplished by O-rings 34, 36.

Diaphragms 38, 40 are clamped between the air chamber housings 12, 14 and pump chamber housing 16 and air chamber housing 18, respectively. The housings provide clamping about the periphery of each diaphragm 38, 40. The air chamber housing 12 defines an air chamber and the pump chamber housing defines a pump chamber. The diaphragm 38 is positioned between the air chamber housing 12 and the pump chamber housing 16 to close the defined air chamber and pump chamber between them. Similarly, the air chamber housing 14 and the air chamber housing 18 define air chambers which are closed by the diaphragm 40 located therebetween.

A shaft 42 extends between the diaphragms 38, 40 and is affixed to the diaphragms 38, 40 by pistons 44, 46. The pistons 44, 46 each include an inner element 48 and an outer element 50 which are threaded to the ends of the shaft 42 to enclose and affix the diaphragms 38, 40 to the shaft 42. The outer element 50 of the piston 46 is shown to have a port 52 through the end thereof for communication between the end of the shaft 42 and the air chamber defined by the air chamber housing 18.

The shaft 42 includes a passageway 54 shown to extend fully through the shaft 42 in an axial position. A passageway 56 extends radially from the passageway 54 to create a passage between the air chamber defined by the air chamber housing 18 and the air chamber defined by the air chamber housing 12. The outer element 50 of the piston 44 is shown to close off the end of the passageway 54.

In operation, air is alternately directed to the air chambers defined by the air chamber housings 12, 14. This alternating flow of compressed air results in the two diaphragms 38, 40, the shaft 42 through the air valve 10 and the associated pistons 44, 46 reciprocating back and forth. With that reciprocation, flowable material in the pump chamber housing 16 is alternately drawn in through the intake valve 24 and forced out through the exhaust valve 26 in a pumping action.

The pressure exerted by the diaphragm 38 and piston 44 is increased through the flow of pressurized air from the air chamber defined by the air chamber housing 12 through the passage defined by the passageways 56 and 54 and the port 52. As compressed air accumulates in the air chamber housing 18, the diaphragm 40 also acts to force the shaft 42 in the exhaust stroke into the pump chamber defined by the pump chamber housing 16. On the suction stroke for that pump chamber, only the pressure developed in the second air chamber housing 14 drives the shaft and the first diaphragm 38. During this time, air is exhausted from the air chamber housing 18 through the passageway 54.

Thus, an improved air driven double diaphragm pump having an increased pressure capacity is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An air driven diaphragm pump comprising a first air chamber housing defining a first air chamber;

a second air chamber housing defining a second air chamber;

an air valve, the first air chamber and the second air chamber being on opposite sides of the air valve with the air valve therebetween;

a first diaphragm;

a second diaphragm;

a pump chamber housing defining a pump chamber outwardly of the first air chamber housing with the first diaphragm between and closing each of the first air chamber and the pump chamber;

a third air chamber housing defining a third air chamber outwardly of the second air chamber housing with the second diaphragm between and closing each of the second air chamber and the third air chamber;

a shaft extending through the air valve and being affixed at a first end to the first diaphragm and at a second end to the second diaphragm, the shaft including a passage in communication with the first air chamber and the third air chamber.

2. The air driven diaphragm pump of claim 1, the passage including an axial passageway at least partially through the shaft and in communication with the third air chamber and a radial passageway from the axial passageway in communication with the first air chamber.

3. The air driven diaphragm pump of claim 1 further comprising pistons affixed to the shaft at either end thereof and retaining the first and second diaphragms, respectively, the shaft extending through the second diaphragm and being open through the piston to the third air chamber.

* * * * *